US007965251B2

(12) United States Patent
Hesselbarth

(10) Patent No.: US 7,965,251 B2
(45) Date of Patent: Jun. 21, 2011

(54) RESONANT CAVITIES AND METHOD OF MANUFACTURING SUCH CAVITIES

(75) Inventor: Jan Hesselbarth, Dublin (IE)

(73) Assignee: Alcatel-Lucent USA Inc., Murray Hill, NJ (US)

( * ) Notice: Subject to any disclaimer, the term of this patent is extended or adjusted under 35 U.S.C. 154(b) by 954 days.

(21) Appl. No.: 11/523,998

(22) Filed: Sep. 20, 2006

(65) Prior Publication Data

US 2008/0068104 A1 Mar. 20, 2008

(51) Int. Cl.
*H01Q 13/10* (2006.01)

(52) U.S. Cl. ..... 343/767; 333/206; 333/222; 333/231

(58) Field of Classification Search ..... None
See application file for complete search history.

(56) References Cited

U.S. PATENT DOCUMENTS

| | | | | |
|---|---|---|---|---|
| 4,100,500 | A * | 7/1978 | Ohsawa et al. | 329/337 |
| 5,329,687 | A * | 7/1994 | Scott et al. | 29/527.2 |
| 6,255,917 | B1 * | 7/2001 | Scott | 333/202 |
| 6,992,548 | B2 * | 1/2006 | Fukunaga | 333/208 |

FOREIGN PATENT DOCUMENTS

| | | |
|---|---|---|
| EP | 0 008 790 | 3/1980 |
| EP | 0 874 414 | 10/1998 |
| WO | PCT/US2007/019728 | 2/2008 |

OTHER PUBLICATIONS

T. J. Mueller, "SMD-Type 42 GHz Waveguide Filter". Proc. IEEE Intern. Microwave Symp., Philadelphia, 2003, pp. 1089-1092.

Lucent patent application, Hesselbarth 2, U.S. Appl. No. 11/524,111, filed Sep. 20, 2006, "Re-Entrant Resonant Cavities And Method Of Manufacturing Such Cavities".

Lucent patent application, Hesselbarth 4, U.S. Appl. No. 11/524,136, filed Sep. 20, 2006, "Re-Entrant Resonant Cavities, Filters Including Such Cavities And Method Of Manufacture".

Mueller, Thomas J., "SMD-type 42 GHz waveguide filter", 2003 IEEE MTT-S International Microwave Symposium Digest, New York, NY, vol. 3 of 3, Jun. 2003, pp. 1089-1092.

* cited by examiner

*Primary Examiner* — Trinh V Dinh
(74) *Attorney, Agent, or Firm* — Gillian Cockayne

(57) ABSTRACT

A re-entrant resonant cavity 12 includes three parts 18, 19 and 20 which may be manufactured as metallized plastic components. The three parts 18, 19 and 20 are soldered to a multilayer PCB 23 using surface mount technology. The re-entrant stub 16 is in two portions with dielectric material provided by the PCB 23 between them. The cylindrical wall 13 surrounding the stub 16 is also divided into two sections 21 and 22 by the PCB 23. Vias 24 and 25 electrically connect the parts separated by the PCB 23. The pattern of the vias 24 and 25 determines the inductance of the cavity, and hence its resonance frequency. This enables cavities with the same geometry to be operated at different resonance frequencies by using different configurations of through connects. One of the sets of vias may be omitted in some cavities.

23 Claims, 2 Drawing Sheets

RESONANT CAVITIES AND METHOD OF MANUFACTURING SUCH CAVITIES

FIELD OF THE INVENTION

The present invention relates to resonant cavities and to a method of manufacturing such cavities. More particularly, but not exclusively, it relates to re-entrant resonant cavities manufactured using surface mount techniques and to multi-resonator filter arrangements.

BACKGROUND OF THE INVENTION

A resonant cavity is a device having an enclosed volume bounded by electrically conductive surfaces and in which oscillating electromagnetic fields are sustainable. Resonant cavities may be used filters, for example, and have excellent power handling capability and low energy losses. Several resonant cavities may be coupled together to achieve sophisticated frequency selective behavior.

Resonant cavities are often milled in, or cast from, metal. The frequency of operation determines the size of the cavity required, and, in the microwave range, the size and weight are significant. In a re-entrant resonant cavity, the electric and magnetic parts of the electromagnetic field within the cavity volume are essentially geometrically separated, enabling the size of the cavity to be reduced compared to that of a cylindrical cavity having the same resonance frequency.

Since the geometrical shape of a resonant cavity determines its frequency of resonance, high mechanical accuracy is required and, in addition, or alternatively, post-production tuning is applied. For example, tuning mechanisms may be provided, such as tuning screws that project into the cavity volume by a variable amount and are adjusted manually. FIG. 1 schematically illustrates a re-entrant resonant cavity 1 which includes a manually adjusted tuning mechanism. The cavity 1 has an enclosed volume 2 defined by a cylindrical outer wall 3, end walls 4 and 5, and a re-entrant stub 6 extensive from one of the end walls 4. The electric field concentrates in the capacitive gap 7 between the end face 8 of the stub 6 and part 9 of the cavity wall 5 facing it. The end face 8 includes a blind hole 10 aligned with the longitudinal axis X-X of the stub 6. A tuning screw 11 projects from the end wall 5 into the hole 10. Energy is coupled into the resonant cavity and an operative monitors the effect on resonant frequency as he moves the tuning screw 11 in an axial direction relative to the end face 8, as shown by the arrow, to alter the value of the capacitance of the capacitive gap. This enables the resonance frequency of the cavity to be adjusted to the required value.

One known method for reducing the weight of a cavity is to manufacture it in plastic and cover its surface with a thin metal film. If milling is used to shape the plastic, it can be difficult to achieve sufficient accuracy, and surface roughness may be an issue. Molding is another approach, but the tooling is expensive, particularly when the cavities are combined together as a filter. In a typical multi-resonator filter, for example, the resonance frequencies of most of the included resonators differ from one another. The filter functionality requires slightly different resonance frequencies and therefore slightly different geometries for the resonators. As a consequence, if molding techniques are used, for example, plastics injection molding, a single molding form must be configured to define all of the resonators. Such a complex form is difficult to produce with sufficient accuracy, and hence incurs significant costs.

T. J. Mueller, "SMD-type 42 GHz waveguide filter", Proc. IEEE Intern. Microwave Symp., Philadelphia, 2003, pp. 1089-1092 describes manufacture of a waveguide filter using surface mount soldering in which a U-shaped metal filter part is soldered onto a printed circuit board (PCB), using the board metallization to define one of the waveguide walls.

BRIEF SUMMARY OF THE INVENTION

According to an aspect of the invention, a resonant cavity comprises a first cavity part and a second cavity part, the parts having electrically conductive surfaces that at least partly define a resonant volume. Dielectric material is included between the first and second parts and an electrically conductive path extends through the dielectric material to electrically connect the first and second cavity parts.

One of the parameters which governs the resonant frequency of a cavity is its inductance. During operation, electrical current flows around the surfaces of the cavity that define the resonant volume. A longer current path in a cavity gives an increased inductance, and hence a lower resonance frequency. By using the invention, the configuration of the electrically conductive path can be selected so as to control the inductance included in the cavity and thus tune its resonance frequency without needing to alter the geometry of the first and second cavity parts. This provides a cost effective method for producing a cavity that is capable of being manufactured with a resonance frequency falling within a range of possible resonance frequencies. One benefit is that, where expensive tooling is required to form a particular cavity part, this need not be provided for every desired resonance frequency in the range of those that are possible. Thus, for example, where a cavity part is formed from metallized plastic by injection molding, say, only a single more complex, and hence more expensive, molding form is required, with the conductive path being appropriately configured to obtain the correct resonance frequency. This is particularly useful where the resonant cavity is a re-entrant cavity having a re-entrant stub extensive into the resonant volume. The dimensions of such a cavity must be reproducible with close tolerances in order to achieve the desired performance, placing demands on the manufacturing process that result in increased costs. The invention thus may allow the overall costs to be reduced.

The conductive path may be defined by a single, circumferential track, for example. However, it more typically is defined by a plurality of tracks. The dielectric material between the cavity parts may be provided by a planar member, this being a convenient shape that allows accurate dimensions to be achieved. For example, the dielectric material may be provided by a printed circuit board. Use of a printed circuit board (PCB) is particularly suited to surface mount technology, aiding in accurate positioning of the first and second cavity parts on the PCB during manufacture. Vias through the planar member may be coated, or filled, with metal to provide the conductive path. The vias may be formed as a circular arrangement of holes, or could consist of arcuate filled slots, for example. The spacing and diameter of the through connections affect the inductance obtained by a particular configuration of conductive path. Other arrangements are possible depending on the current flow it is wished to establish in the cavity.

In a re-entrant resonant cavity, the stub may be formed as two portions and dielectric material located between them, with a conductive path through the dielectric material. Alternatively, or in addition, a cavity wall at least partly surrounding the stub may be connected to another cavity part by a conductive path through dielectric material. If both possibilities are included in a cavity, it may permit a greater range of resonance frequencies to be available from which to select the actual operating resonance frequency than if only one of these possibilities is available.

In another aspect of the invention, a filter arrangement includes a plurality of re-entrant resonant cavities, at least one of which comprises a first cavity part and a second cavity part, with dielectric material between them and an electrically conductive path through the dielectric material to electrically connect the first and second cavity parts. The first cavity parts may include at least a portion of the re-entrant stub where the cavities are re-entrant cavities and, by using the invention, may be identical for a plurality of the cavities included in the filter arrangement, even though they are required to have different resonance frequencies. In one embodiment of the invention, a PCB is included in a plurality of resonant cavities to provide the dielectric material in each of them. The PCB may carry at least one conductive track for coupling between cavities included in the filter arrangement. The geometry of a conductive track, where it acts to couple energy into or out of a cavity, affects the coupling between cavities in a filter. Different geometries may be readily implemented on a PCB, giving additional design freedom.

By using the invention, identical first cavity parts may be included in respective re-entrant resonant cavities having different resonance frequencies. This enables overall tooling costs to be reduced, as the quantities are greater than is the case where each resonance frequency demands an individual molding form. This is particularly advantageous where a plurality of re-entrant resonant cavities is combined in a filter arrangement In a further aspect of the invention, a method of manufacturing a resonant cavity including the steps of: forming a first cavity part and a second cavity part, the parts having electrically conductive surfaces that at least partly define the resonant volume of the cavity; locating dielectric material between the first and second cavity parts; and defining a conductive path through the dielectric material to electrically connect the first and second parts. The dielectric material may, for example, be provided by a PCB, this being particularly suitable for automated manufacture.

BRIEF DESCRIPTION OF THE DRAWINGS

Some methods and embodiments in accordance with the present invention will now be described by way of example only, and with reference to the accompanying drawings, in which.

DETAILED DESCRIPTION

Figure 1:
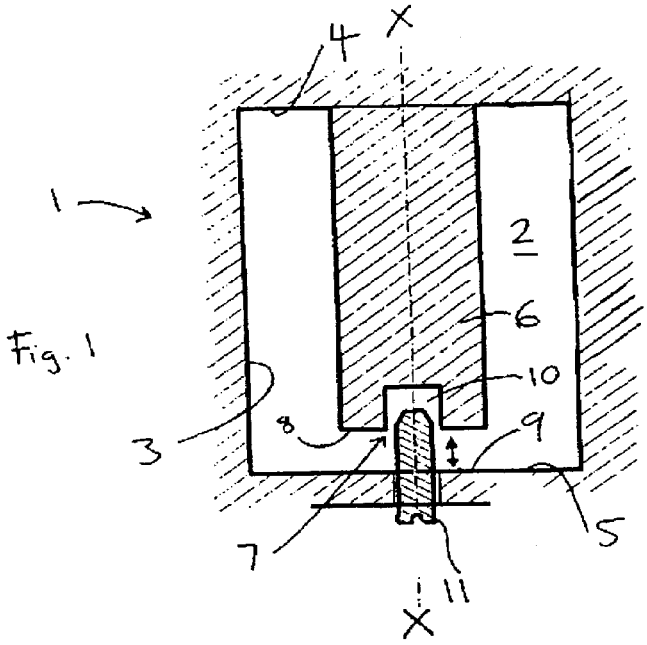
FIG. 1 schematically illustrates a previously known re-entrant resonant cavity.
Figure 2:
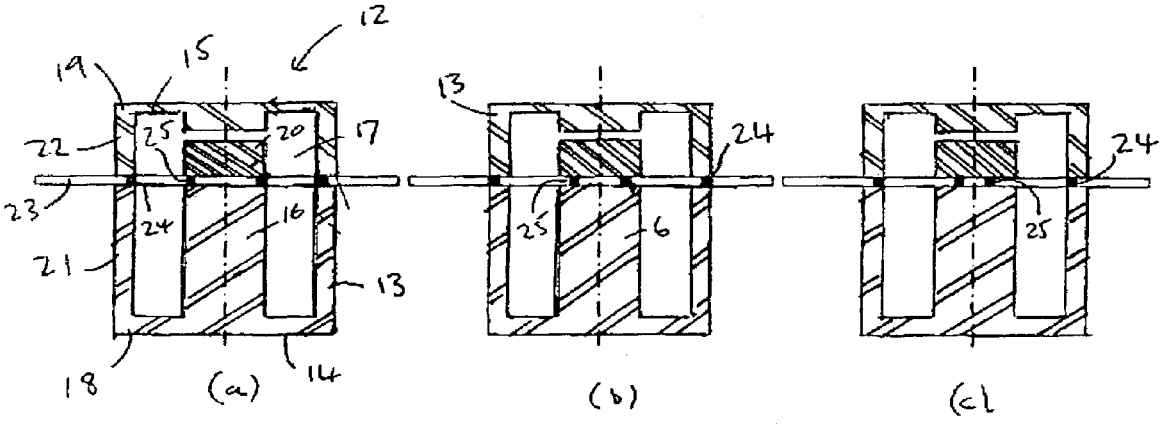
FIGS. 2(*a*), (*b*) and (*c*) schematically illustrate in sectional view re-entrant resonant cavities and methods of manufacture in accordance with the invention.

With reference to FIG. 2(*a*), a re-entrant microwave resonant cavity 12 comprises a cylindrical wall 13, with first and second end walls 14 and 15 respectively at each end. A stub 16 is extensive from the first end wall 14 along the longitudinal axis X-X of the cylindrical wall 13. The cylindrical wall 13, end walls 14 and 15, and stub 16 define a resonant volume 17.

The cavity 12 includes three component parts 18, 19 and 20. A section 21 of the cylindrical wall 13, the first end wall 14 and a portion of the stub 16 are integrally formed as a single molded plastic component 18, the interior surface of which is metallized with a layer of silver. Another section 22 of the cylindrical wall 13 and the second end wall 15 are included in another integrated component 19, and an end portion 20 of the stub is also separately formed as a single item. A multilayer PCB 23 is included in the cavity 12. The first component 18 is mounted on one side of the PCB 23, using surface mount technology to get accurate placement. The integrated component 19 is mounted on the other side of the PCB 23, located so that the inner surface of the two cylindrical wall sections 21 and 22 are aligned. The end portion 20 of the stub 16 is centrally mounted inside the integrated component 19, again using surface mount technology to get accurate relative positioning between the component parts. The component surfaces that are adjacent the PCB 23 are metallized and soldered to corresponding solder pads on the PCB 23 during the manufacturing process.

A circular pattern of metal-filled vias 24 through the PCB 23 connects the two sections of the cylindrical wall 13, providing a conductive path between them via the metallization of the surfaces located next to the PCB 23. The vias 24 are located on a diameter that is the same as that of the internal surface of the cylindrical wall 13. The PCB 24 also includes a second pattern of vias 25 to provide a conductive path between the two portions of the stub 16. The diameter of the circle on which the vias 25 lie is corresponds to the diameter of the stub 16. Thus, in this cavity, the two sets of vias 24 and 25 are located so as to provide the shortest possible path between the inner surfaces of the cavity 12, and hence, the lowest inductance for this cavity geometry. Accordingly, the resonant frequency is the highest achievable in the available range.

With reference to FIG. 2(*b*), in an alternative conductive path configuration to that shown in FIG. 2(*a*), the metal through connections 24 between the two sections of the cylindrical wall 13 are defined by a plurality of metal-filled holes that are positioned such that they are in alignment with the outer diameter of the cylindrical wall 13. The vias 25 connecting the two portions of the stub 16 are on a smaller diameter than that of the configuration shown in FIG. 2(*a*). Locating the vias 24 and 25 as shown in FIG. 2(*b*) leads to a longer current path compared to that shown in FIG. 2(*a*) and thus to a lower resonant frequency. FIG. 2(*c*) shows another arrangement in which the vias 25 connecting the two portions of the stub 16 are moved inwardly compared to that shown in FIG. 2(*a*) but the outer vias 24 connecting the sections of the cylindrical wall 13 are in the same position. This configuration gives an increased inductance compared to that shown in FIG. 2(*a*) but not so great a change as that achieved with the configuration shown in FIG. 2(*b*).

Figure 3:
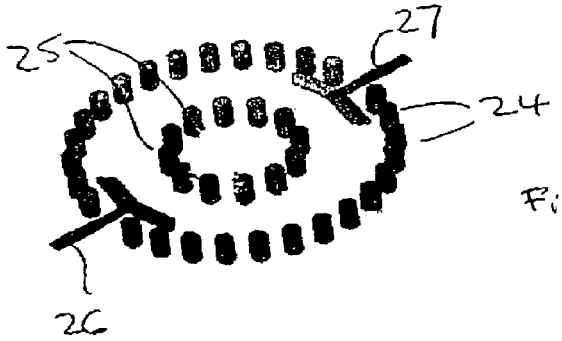
FIGS. 3 and 4 schematically illustrate parts of one of the re-entrant resonant cavities of FIG. 2 in greater detail.

FIG. 3 illustrates in schematic three-dimensional form the arrangement of the vias 24 and 25 of the cavity shown in FIG. 2(*a*). It also shows two arcuate coupling connectors 26 and 27, for signals to be coupled in or out of the cavity, which are included in one of the layers of the multilayer PCB 23. The geometry of the connectors may be changed to achieve different coupling performance.

Figure 4:
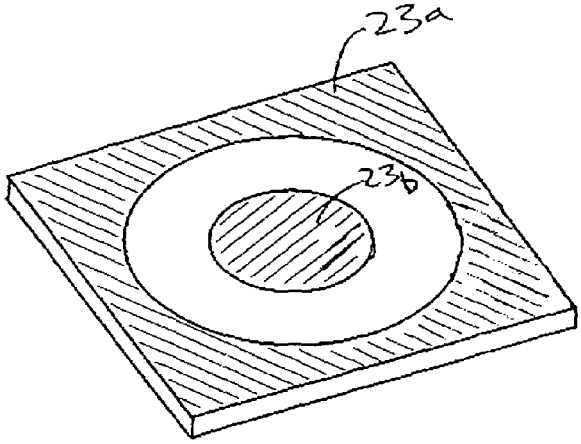

With reference to FIG. 4, the PCB 23 includes metal regions 23*a* and 23*b* defined by etching away metal from a metallization layer. This pattern is includes on both sides of the PCB 23, with the stub portions being soldered onto the central metal regions 23*b* and the outer footprint of the cavity to the outer region 23*a*.

The component parts 18, 19 and 20 of the cavity shown in FIG. 2(*a*) are metallized molded plastic. In other embodiments, some or all of these components may be wholly of metal, or may be manufactured using other techniques.

To provide an increased range of possible resonance frequencies, the thickness of the cylindrical wall may be increased, either along its entire length or as flanges where they face, and are fixed to, the PCB.

As an alternative to a single PCB extensive across the cavity, the dielectric material may be provided by a separate piece located between portions of the stub and another piece between the two sections of the surrounding cylindrical wall.

In another embodiment of the invention, a re-entrant resonant cavity only includes one of the set of vias compared to the two shown in the cavity of FIG. 2(*a*). The stub is formed in a single piece rather than as two portions and a surrounding cylindrical wall is separated by dielectric material into two parts. Where the dielectric material is provided by a PCB, say, extensive across the resonant volume, the stub may be in one piece and project through an aperture extending through the PCB. This may only be practicable for smaller diameter stubs due to current manufacturing constraints.

In an alternative embodiment, the stub is made up of two portions with intervening dielectric material and a cylindrical surrounding cavity wall is in a single piece.

Figure 5:
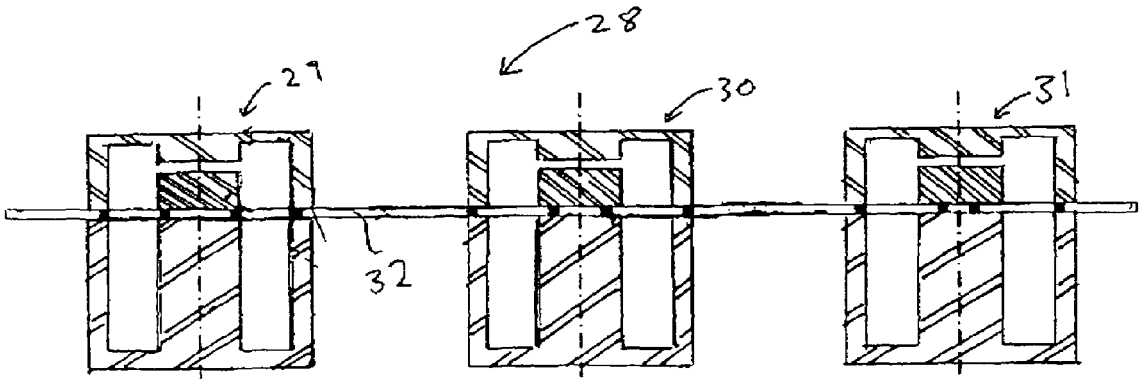
FIG. 5 schematically illustrates a filter arrangement in accordance with the invention.

With reference to FIG. 5, a filter arrangement 28 comprises a plurality of re-entrant resonant cavities 29, 30 and 31, each of which includes identical component parts with a common interposed PCB 32. The through connecting vias through the PCB 32 are configured differently, such that each cavity operates at a different resonance frequency of the others. Connections between the cavities are made via conductive tracks included in the PCB 32.

The present invention may be embodied in other specific forms, and implemented by other methods, without departing from its spirit or essential characteristics. The described embodiments and methods are to be considered in all respects only as illustrative and not restrictive. The scope of the invention is, therefore, indicated by the appended claims rather than by the foregoing description. All changes that come within the meaning and range of equivalency of the claims are to be embraced within their scope.

I claim:

1. A method of manufacturing a resonant cavity including steps of: forming a first cavity part and a second cavity part, the parts having electrically conductive surfaces that at least partly define the resonant volume of the cavity; locating a plate of dielectric material between the first and second cavity parts, the dielectric plate being interposed between the first and second cavity parts; and defining at least one conductive path through the dielectric plate that is electrically continuous with the electrically conductive surfaces of the first and second parts.

2. The method as claimed in claim 1 wherein the cavity is a re-entrant resonant cavity comprising a re-entrant stub extensive into the volume, and including the step of forming the first cavity part as a component that includes at least a portion of the stub and a cavity wall from which the stub is extensive.

3. The method as claimed in claim 2 wherein the first cavity part is of metallized plastic and including the step of forming the first cavity part by molding.

4. The method as claimed in claim 1 further including a step of joining the first cavity part, dielectric plate, and second cavity part by surface mount soldering.

5. The method as claimed in claim 1 further including a step of defining the conductive path by forming a pattern of metallized vias through the dielectric plate.

6. The method as claimed in claim 2 further including steps of manufacturing a plurality of re-entrant resonant cavities and connecting them together to form a filter arrangement.

7. The method as claimed in claim 6 wherein at least some cavities of the plurality each includes an identical first cavity part and the method further comprises a step of differently configuring conductive paths of respective cavities with an identical first cavity part to provide respective different resonance frequencies.

8. The method as claimed in claim 7 further including molding the first cavity parts in plastic and metallizing them.

9. The method as claimed in claim 6 wherein the dielectric plate is interposed within more than one cavity of the plurality.

10. A resonant cavity comprising: a first cavity part and a second cavity part, said parts having electrically conductive surfaces that at least partly define a resonant volume; a dielectric plate interposed between the first and second parts; and at least one electrically conductive path through the dielectric plate that is electrically continuous with the electrically conductive surfaces of the first and second cavity parts.

11. The cavity as claimed in claim 10 wherein the cavity is a re-entrant resonant cavity and includes a re-entrant stub extensive into said volume.

12. The cavity as claimed in claim 11 wherein the first cavity part includes at least a portion of the re-entrant stub and a cavity wall from which said stub is extensive.

13. The cavity as claimed in claim 12 wherein the stub is in two portions with the dielectric plate disposed between them and an electrically conductive path through the dielectric plate to electrically connect the portions.

14. The cavity as claimed in claim 13 further including a cavity wall at least partly surrounding the stub, and including the dielectric plate between the wall and the first cavity part, and a conductive path through the dielectric plate to electrically connect the wall and the first cavity part.

15. The cavity as claimed in claim 14, wherein the dielectric plate is extensive between the first cavity part and the wall, and between the two portions of the stub, and wherein conductive vias are included through the planar member to provide the conductive path.

16. The cavity as claimed in claim 15 wherein the conductive vias are provided in a circular pattern between the first cavity part and the wall, and in a circular pattern between the two portions of the stub.

17. The cavity as claimed in claim 12 wherein the second cavity part comprises a cavity wall at least partly surrounding the stub.

18. The cavity as claimed in claim 10 wherein at least one of the first and second cavity parts is fixed on the dielectric plate.

19. The cavity as claimed in claim 10 wherein at least one of the first and second cavity parts is of metallized molded plastic.

20. A filter arrangement including a plurality of re-entrant resonant cavities, at least one of which comprises: a first cavity part and a second cavity part, said parts having electrically conductive surfaces that at least partly define a resonant volume; a dielectric plate interposed between the first and second parts; and at least one electrically conductive path through the dielectric plate that is electrically continuous with the electrically conductive surfaces of the first and second cavity parts.

21. A filter arrangement as claimed in claim 20 wherein at least some cavities of the plurality comprise a component that includes a re-entrant stub and which is identically shaped for respective different cavities, and the conductive paths of said at least some cavities being differently configured to provide different resonance frequencies for respective cavities.

22. The filter arrangement as claimed in claim 20 wherein the dielectric plate is included in more than one cavity of the said plurality.

23. A filter arrangement as claimed in claim 20, wherein the dielectric plate is provided by a printed circuit board and the printed circuit board carries at least one conductive track for coupling between cavities included in said plurality.

* * * * *